US009103505B2

(12) United States Patent
Kuo et al.

(10) Patent No.: US 9,103,505 B2
(45) Date of Patent: Aug. 11, 2015

(54) HEAT DISSIPATION STRUCTURE FOR LED LIGHTING

(75) Inventors: Ding-Hua Kuo, New Taipei (TW); Wen-Ji Lan, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 534 days.

(21) Appl. No.: 13/212,139

(22) Filed: Aug. 17, 2011

(65) Prior Publication Data

US 2013/0044490 A1 Feb. 21, 2013

(51) Int. Cl.

| | |
|---|---|
| ***F21V 29/67*** | (2015.01) |
| ***F21K 99/00*** | (2010.01) |
| ***F21V 29/00*** | (2015.01) |
| ***F21V 3/02*** | (2006.01) |
| ***F21V 29/02*** | (2006.01) |
| ***F21V 29/506*** | (2015.01) |
| ***F21V 29/83*** | (2015.01) |
| *F21Y 101/02* | (2006.01) |

(52) U.S. Cl.

CPC . *F21K 9/135* (2013.01); *F21V 3/02* (2013.01); *F21V 29/02* (2013.01); *F21V 29/2212* (2013.01); *F21V 29/506* (2015.01); *F21V 29/677* (2015.01); *F21V 29/83* (2015.01); *F21Y 2101/02* (2013.01)

(58) Field of Classification Search

USPC ..... 362/294, 235, 249.02, 311.01, 311.02, 362/311.06, 311.13, 311.14, 311.15, 351; 313/45, 46; 174/252; 257/712

See application file for complete search history.

(56) References Cited

U.S. PATENT DOCUMENTS

| | | | | |
|---|---|---|---|---|
| 8,414,160 | B2 * | 4/2013 | Sun et al. | 362/294 |
| 8,487,518 | B2 * | 7/2013 | Johnston et al. | 313/46 |
| 2010/0314985 | A1 * | 12/2010 | Premysler | 313/46 |
| 2011/0089830 | A1 * | 4/2011 | Pickard et al. | 315/32 |
| 2011/0090686 | A1 * | 4/2011 | Pickard | 362/235 |
| 2013/0016508 | A1 * | 1/2013 | Progl et al. | 362/235 |

* cited by examiner

*Primary Examiner* — Jong-Suk (James) Lee
*Assistant Examiner* — Leah S Macchiarolo
(74) *Attorney, Agent, or Firm* — C. G. Mersereau; Nikolai & Mersereau, P.A.

(57) ABSTRACT

A heat dissipation structure for LED lighting includes a light shade, at least one LED module, a wind guide member and a light seat. The light shade has a first opening and a second opening. The light shade further has at least one first extension section between the first and second openings. The LED module is inlaid in the first extension section. The light seat is connected with the light shade to form at least one perforation therebetween. The wind guide member serves to directly suck in airflow through the perforation to dissipate the heat generated by the LED module. The heat of the LED module is carried out of the first opening so as to lower the temperature of the LED module. Accordingly, the heat dissipation structure is free from any radiating fin assembly so that the total weight is reduced and the heat dissipation efficiency is enhanced.

7 Claims, 8 Drawing Sheets

HEAT DISSIPATION STRUCTURE FOR LED LIGHTING

BACKGROUND OF THE INVENTION

1. Field of the Invention

The present invention relates generally to a heat dissipation structure for LED lighting, and more particularly to a heat dissipation structure for LED lighting, which has better heat dissipation efficiency and lighter weight.

2. Description of the Related Art

Recently, various green products meeting the requirements of energy saving and carbon reduction have been more and more respected. Following the rapid advance of manufacturing technique of light-emitting diode (hereinafter abbreviated as LED), various LED products have been widely applied in various fields as illumination devices, such as LED car lights, LED streetlights, LED desk lamps and LED lightings.

When high-power LED emits light, LED also generates high heat. The heat must be efficiently dissipated. Otherwise, the heat will locally accumulate where the light-emitting component is positioned to cause rise of temperature. This will affect the normal operation of some components of the product or even the entire product and shorten the lifetime of the product.

Taking a conventional LED lighting as an example for illustration, the conventional LED lighting lacks any heat dissipation structure for dissipating the heat. Therefore, after a long period of use, the heat generated by the LED will accumulate in the LED lighting without being effectively dissipated. This will lead to burnout of the LED due to overheating. To solve this problem, some manufacturers have developed improved LED lightings with heat sinks inside for dissipating the heat. However, the heat sinks still cannot provide satisfactory heat dissipation effect. Therefore, some manufacturers have developed heat dissipation structures with fans for LED lightings.

Please refer to FIGS. 1A and 1B. A conventional heat dissipation structure for LED lighting includes a light seat 10, a light shade 11, a fan 12, a radiating fin assembly 13 and an LED module 14. The light seat 10 is assembled and connected with the light shade 11. The light seat 10 has an internal receiving space 101. The fan 12 is disposed in the receiving space 101 in a position distal from the light shade 11. The radiating fin assembly 13 is arranged between the fan 12 and the light shade 11. The LED module 14 is positioned between the radiating fin assembly 13 and the light shade 11. The LED module 14 is attached to the radiating fin assembly 13. The light shade 11 covers the LED module 14. When the LED module 14 emits light, the light passes through the light shade 11 and is projected outward. At this time, the LED module 14 generates heat. The radiating fin assembly 13 serves to absorb the heat and the fan 12 blows airflow to the radiating fin assembly 13 and the LED module 14 to dissipate the heat. However, the radiating fin assembly 13 has a considerable weight. This leads to increase of total weight of the LED lighting. Also, it is inconvenient to assemble the components of the LED lighting.

According to the above, the conventional heat dissipation structure for LED lighting has the following shortcomings:

1. The total weight is increased.
2. It is hard to assemble the components.

SUMMARY OF THE INVENTION

A primary object of the present invention is to provide a heat dissipation structure for LED lighting in which a wind guide member serves to directly suck in airflow to dissipate the heat generated by the LED module. The heat dissipation structure is free from any radiating fin assembly so that the total weight is reduced.

A further object of the present invention is to provide the above heat dissipation structure for LED lighting, which has an airflow passage to enhance heat dissipation efficiency.

To achieve the above and other objects, the heat dissipation structure for LED lighting of the present invention includes a light shade, at least one LED module, a wind guide member and a light seat. At least one first opening and at least one second opening are respectively formed at two ends of the light shade. At least one first extension section extends between the first and second openings to interconnect the first and second openings. The first extension section defines a passage. The LED module has a circuit unit and multiple LED chips. The circuit unit is inlaid in the first extension section and partially positioned in the passage. The wind guide member is disposed at the second opening. One side of the wind guide member faces the passage. The light seat has a first end connected with the light shade and a second end having a light head. The light seat is connected with the light shade to form therebetween at least one perforation. The wind guide member serves to directly suck airflow through the perforation into the passage to dissipate the heat generated by the LED module. The heat of the LED module is carried out of the first opening. Accordingly, the heat dissipation structure is free from any radiating fin assembly so that the total weight is reduced and the heat dissipation efficiency is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
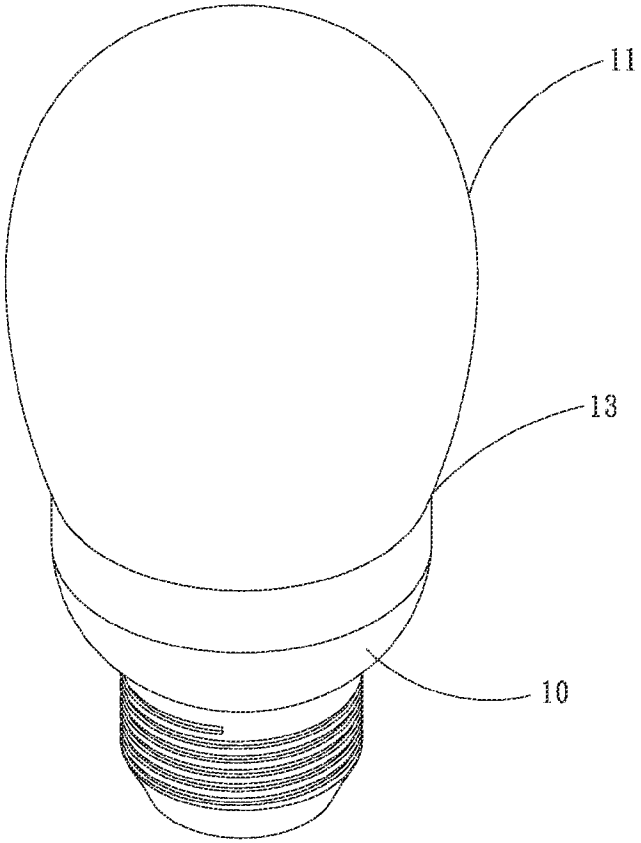
FIG. 1A is a perspective view of a conventional heat dissipation structure for LED lighting.
Figure 1B:
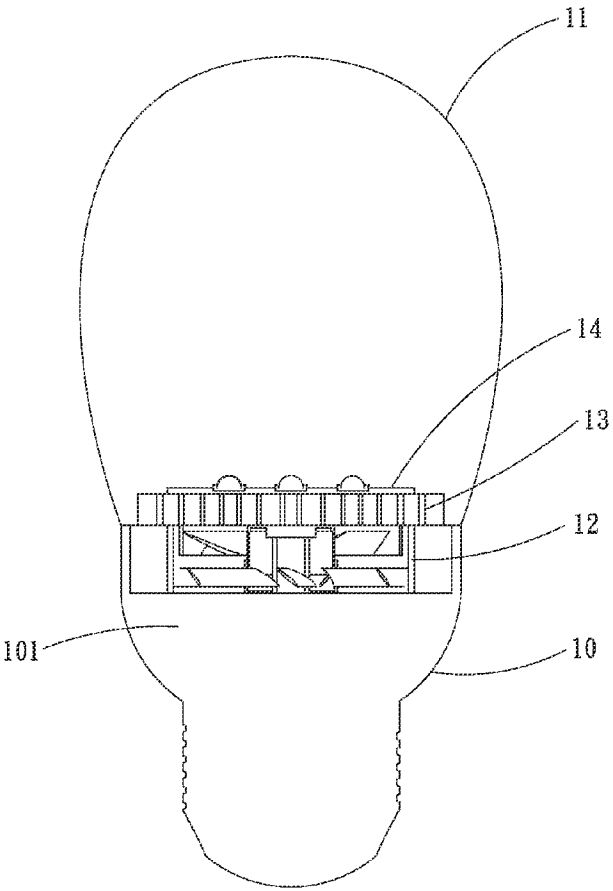
FIG. 1B is a sectional view of the conventional heat dissipation structure for LED lighting.
Figure 2A:
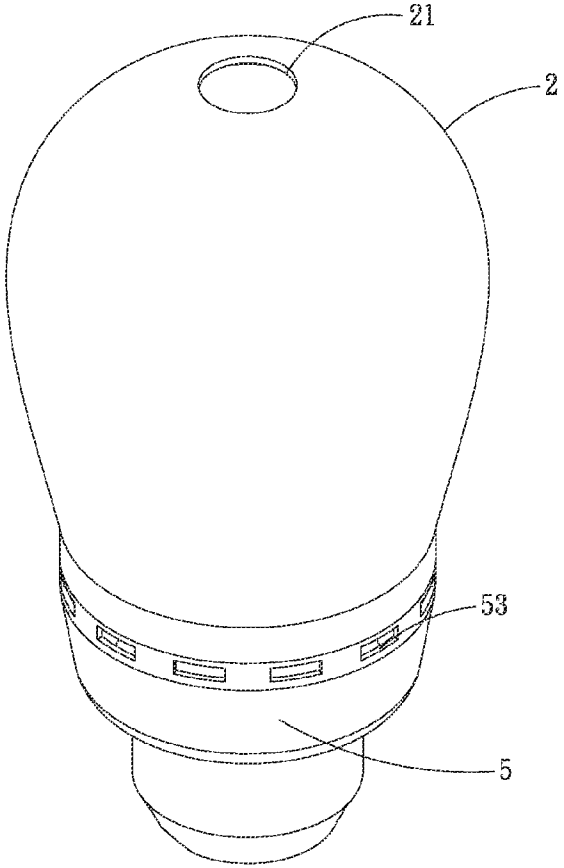
FIG. 2A is a perspective view of a first embodiment of the heat dissipation structure for LED lighting of the present invention.
Figure 2B:
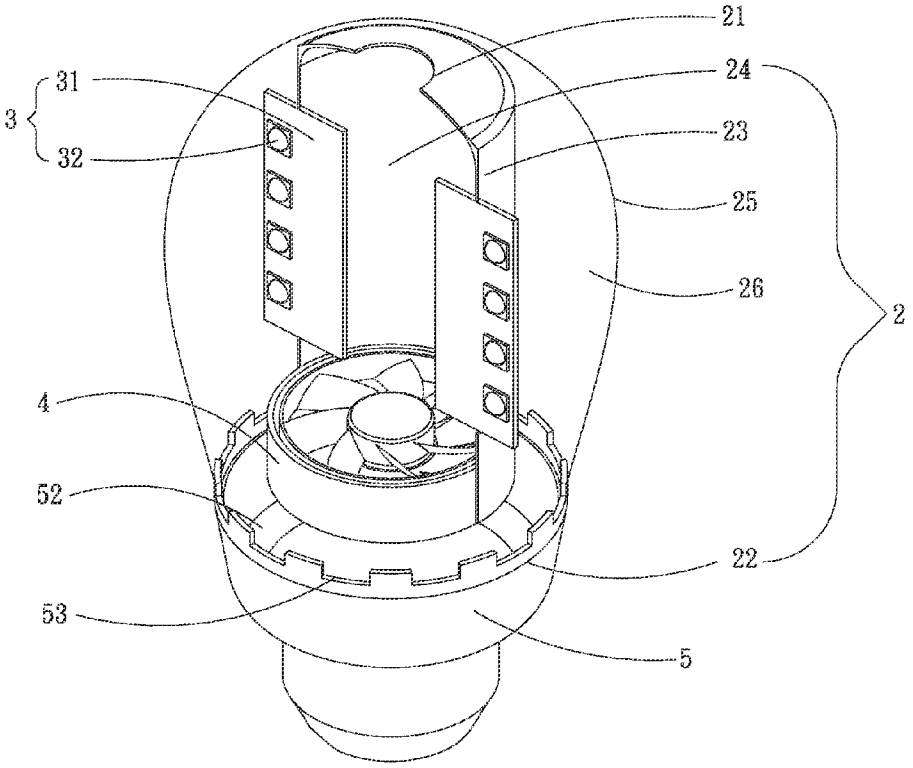
FIG. 2B is a perspective view of the first embodiment of the heat dissipation structure for LED lighting of the present invention, in which a part of the light shade is removed to show the components therein.
Figure 2C:
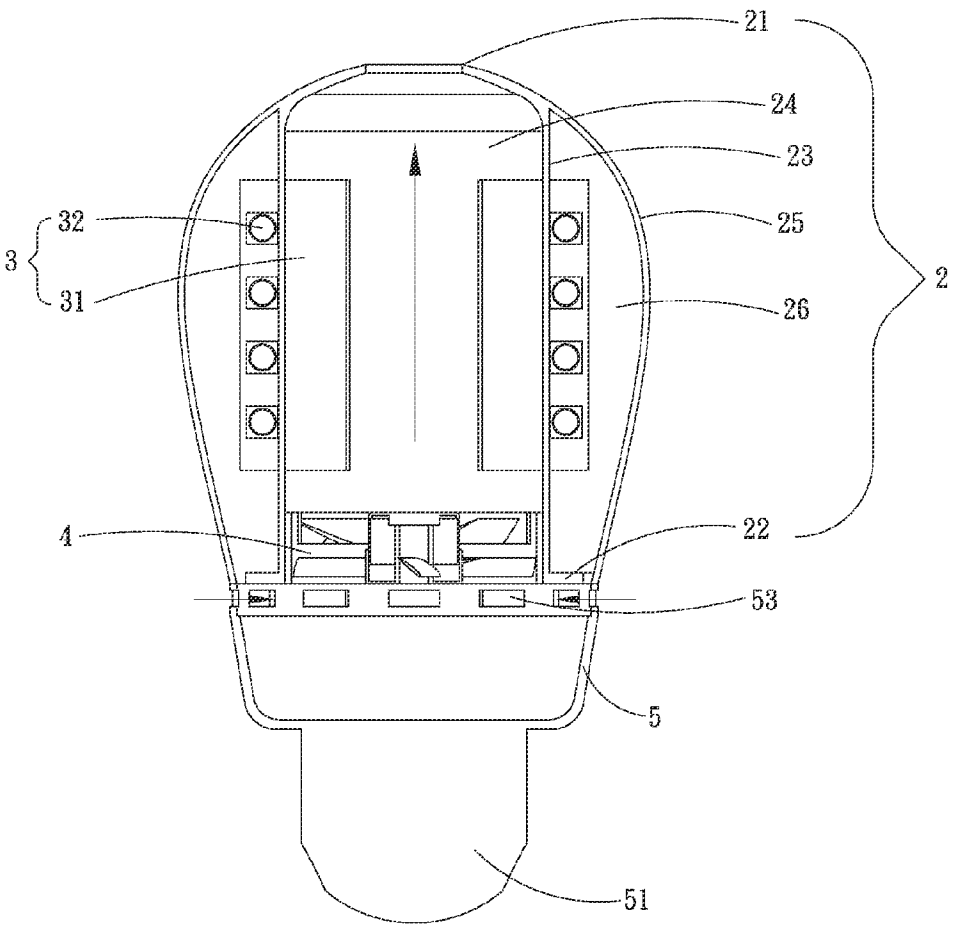
FIG. 2C is a sectional view of the first embodiment of the heat dissipation structure for LED lighting of the present invention.

Please refer to FIGS. 2A, 2B and 2C. FIG. 2A is a perspective view of a first embodiment of the heat dissipation structure for LED lighting of the present invention. FIG. 2B is a perspective view of the first embodiment of the heat dissipation structure for LED lighting of the present invention, in which a part of the light shade is removed to show the components therein. FIG. 2C is a sectional view of the first embodiment of the heat dissipation structure for LED lighting of the present invention. According to the first embodiment, the heat dissipation structure for LED lighting of the present invention includes a light shade 2, at least one LED module 3, a wind guide member 4 and a light seat 5. At least one first opening 21 and at least one second opening 22 are respectively formed at two ends of the light shade 2. At least one first extension section 23 is disposed between the first and second openings 21, 22 to interconnect the first and second openings 21, 22. The first extension section 23 defines a passage 24. In addition, at least one second extension section 25 is disposed between the first and second openings 21, 22. The first and second extension sections 23, 25 together define therebetween a projection space 26.

The LED module 3 has a circuit unit 31 and multiple LED chips 32 arranged at intervals. The LED chips 32 are disposed on the circuit unit 31. The circuit unit 31 is inlaid in the first extension section 23 and partially positioned in the passage 24. The LED chips 32 are positioned in the projection space 26.

The wind guide member 4 is disposed at the second opening 22. One side of the wind guide member 4 faces the passage 24 and the circuit unit 31.

The light seat 5 has a first end connected with the light shade 2 and a second end having a light head 51. The light seat 5 further has a rest section 52 on which the wind guide member 4 is disposed. The light seat 5 is connected with the light shade 2 to form at least one perforation 53. The perforation 53 is formed on the light seat 5 or the light shade 2. In this embodiment, the perforation 53 is formed on the light seat 5.

When the LED module 3 is powered on to operate, the circuit unit 31 generates heat and the LED chips 32 emit light through the projection space 26 and the light shade 2 to outer side. The wind guide member 4 operates at the second opening 22 to suck in airflow through the perforation 53. The wind guide member 4 further blows the airflow to the circuit unit 31 in the passage 24 to dissipate the heat generated by the circuit unit 31 and the LED chips 32. The heat of the circuit unit 31 is carried out of the first opening 21 so as to lower the temperature of the LED module 3. Accordingly, the heat dissipation structure of the present invention is free from any radiating fin assembly so that the total weight is reduced. Alternatively, the wind guide member 4 can be otherwise designed to suck in airflow through the first opening 21 and blow the airflow through the passage 24 and the circuit unit 31 in the passage 24 so as to dissipate the heat of the circuit unit 31. In this case, the heat of the circuit unit 31 is carried out of the perforation 53 to lower the temperature of the LED module 3.

Figure 3A:
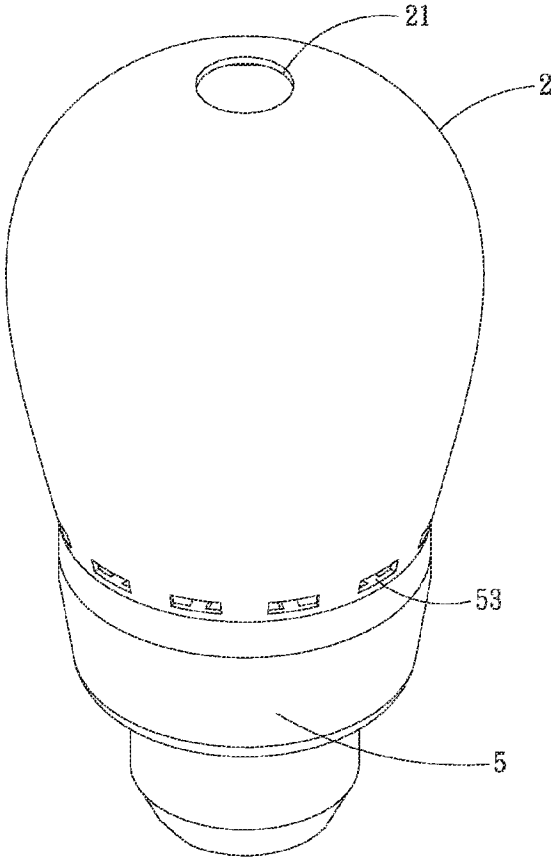
FIG. 3A is a perspective view of a second embodiment of the heat dissipation structure for LED lighting of the present invention.
Figure 3B:
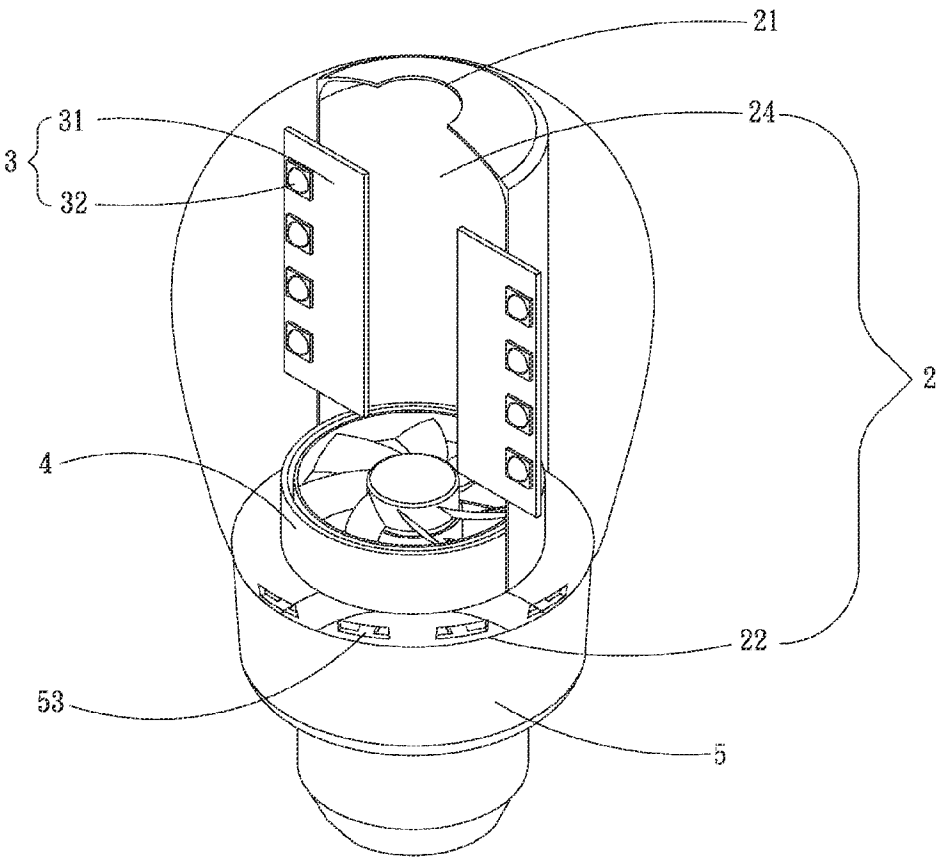
FIG. 3B is a perspective view of the second embodiment of the heat dissipation structure for LED lighting of the present invention, in which a part of the light shade is removed to show the components therein.
Figure 3C:
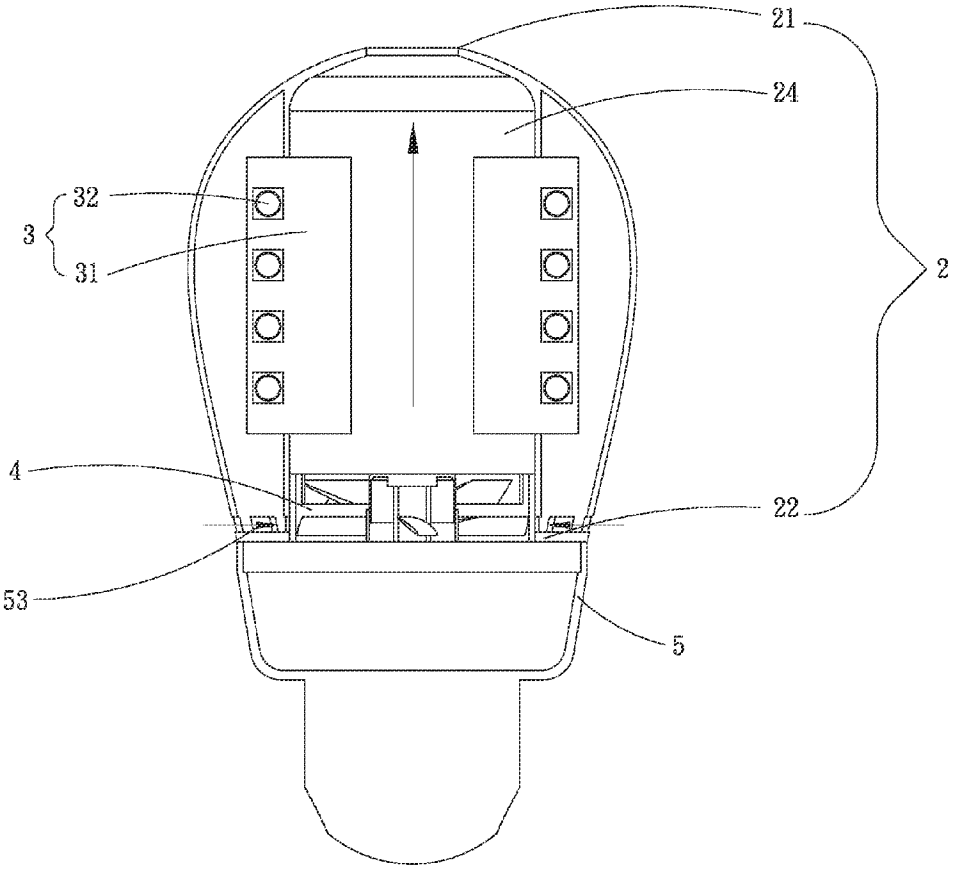
FIG. 3C is a sectional view of the second embodiment of the heat dissipation structure for LED lighting of the present invention.

Please refer to FIGS. 3A, 3B and 3C. FIG. 3A is a perspective view of a second embodiment of the heat dissipation structure for LED lighting of the present invention. FIG. 3B is a perspective view of the second embodiment of the heat dissipation structure for LED lighting of the present invention, in which a part of the light shade is removed to show the components therein. FIG. 3C is a sectional view of the second embodiment of the heat dissipation structure for LED lighting of the present invention. The second embodiment is substantially identical to the first embodiment in structure and connection relationship between the components and thus will not be repeatedly described hereinafter. The second embodiment is different from the first embodiment in that the light seat 5 is connected with the light shade 2 to form the perforation 53. In the second embodiment, the perforation 53 is formed on the light shade 2. The wind guide member 4 operates at the second opening 22 to suck in airflow through the perforation 53. The wind guide member 4 further blows the airflow to the circuit unit 31 in the passage 24 to dissipate the heat generated by the circuit unit 31. The heat of the circuit unit 31 and the LED chips 32 is carried out of the first opening 21 so as to lower the temperature of the LED module 3. Accordingly, the heat dissipation structure of the present invention is free from any radiating fin assembly so that the total weight is reduced.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A heat dissipation structure for LED lighting, comprising:

a light shade having at least one first opening at the top thereof and at least one second opening at the bottom thereof, the light shade further having at least one first extension section extending between the first and second openings to interconnect the first and second openings, the first extension section defining a passage;

at least one LED module having a circuit board inlaid in the first extension section and partially positioned in the passage, and multiple LED chips disposed on the circuit board;

a wind guide member disposed at the second opening, one side of the wind guide member facing the passage for blowing airflow to the circuit board in the passage; and a light seat, one end of the light seat being connected with the bottom of the light shade, at least one perforation being formed between the light seat and the light shade and in communication with the second opening.

2. The heat dissipation structure for LED lighting as claimed in claim 1, wherein the at least one perforation is formed on the light seat.

3. The heat dissipation structure for LED lighting as claimed in claim 1, wherein the at least one perforation is formed on the light shade.

4. The heat dissipation structure for LED lighting as claimed in claim 1, wherein the other end of the light seat has a light head opposite to the light shade.

5. The heat dissipation structure for LED lighting as claimed in claim 1, wherein the light shade further has at least one second extension section extending between the first and second openings, the first and second extension sections together defining therebetween a projection space, the LED chips being disposed in the projection space.

6. The heat dissipation structure for LED lighting as claimed in claim 1, wherein the other side of the wind guide member faces the light seat.

7. The heat dissipation structure for LED lighting as claimed in claim 1, wherein the light seat further has a rest section on which the wind guide member is disposed.

* * * * *